US005947147A

United States Patent [19]

Gnauert et al.

[11] Patent Number: 5,947,147

[45] Date of Patent: Sep. 7, 1999

[54] RECESSED VALVE WITH BUILT-IN BACKFLOW PREVENTER

[75] Inventors: Werner Gnauert, Iserlohn; Frank-Thomas Luig, Fröndenberg, both of Germany

[73] Assignee: Friedrich Grohe AG, Hemer, Germany

[21] Appl. No.: 08/876,182

[22] Filed: Jun. 12, 1997

[30] Foreign Application Priority Data

Jul. 9, 1996 [DE] Germany ..... 196 27 571

[51] Int. Cl.[6] ..... E03C 1/10

[52] U.S. Cl. ..... 137/218; 137/360; 137/597

[58] Field of Search ..... 137/218, 360, 137/597

[56] References Cited

U.S. PATENT DOCUMENTS

| | | | |
|---|---|---|---|
| 5,079,781 | 1/1992 | Gnauert et al. | 137/218 X |
| 5,213,268 | 5/1993 | Gnauert et al. | 137/218 X |
| 5,454,396 | 10/1995 | Hochstrasser | 137/218 |
| 5,497,584 | 3/1996 | Bergmann | 137/360 X |
| 5,701,926 | 12/1997 | Luisi | 137/218 |
| 5,730,173 | 3/1998 | Sponheimer | 137/218 |
| 5,730,184 | 3/1998 | Monch | 137/597 |

FOREIGN PATENT DOCUMENTS

| | | | |
|---|---|---|---|
| 3805462 | 8/1989 | Germany | 137/217 |

*Primary Examiner*—Gerald A. Michalsky
*Attorney, Agent, or Firm*—Herbert Dubno; Andrew Wilford

[57] ABSTRACT

A valve has a housing formed with a connection face, an intake port adapted to be connected to a supply of pressurized liquid, an output port, an intake passage extending from the intake port to the connection face, a bore extending from the connection face, an output passage extending from the bore to the output port, and a bleed passage communicating with the atmosphere and opening into the bore. A valve cartridge secured to the connection face is operable to conduct liquid between the intake passage and the bore. A vent valve mounted in the output bore has inner and outer seats and a valve body movable between end positions in each of which it blocks one of the seats. The outer seat lies between the inner seat and the connection face and the output passage opens into the bore between the seats. The bleed passage opens into the bore through the inner seat.

11 Claims, 5 Drawing Sheets

RECESSED VALVE WITH BUILT-IN BACKFLOW PREVENTER

FIELD OF THE INVENTION

The present invention relates to a valve. More particularly this invention concerns a mixing valve with a built-in diverter and backflow preventer.

BACKGROUND OF THE INVENTION

A standard recessed valve has a housing formed with a connection face, an intake port adapted to be connected to a supply of pressurized liquid, an output port, an intake passage extending from the intake port to the connection face, and an output passage extending from the bore to the output port. A valve cartridge secured to the connection face is operable to conduct liquid between the intake passage and the bore.

When such a valve is used with, for example, a fitting like a telephone shower there is the potential of back flow from the fitting into the lines in the event of a pressure inversion. The code therefore requires that the system be fitted with a backflow preventer that vents and/or blocks flow back in case of such a pressure inversion. Such retrofitting with these extra elements is time consuming and expensive, and they take up extra space in often very cramped situations.

OBJECTS OF THE INVENTION

It is therefore an object of the present invention to provide an improved valve.

Another object is the provision of such an improved valve which overcomes the above-given disadvantages, that is which has a built-in backflow preventer of simple and inexpensive construction.

SUMMARY OF THE INVENTION

A valve has according to the invention a housing formed with a connection face, an intake port adapted to be connected to a supply of pressurized liquid, an output port, an intake passage extending from the intake port to the connection face, a bore extending from the connection face, an output passage extending from the bore to the output port, and a bleed passage communicating with the atmosphere and opening into the bore. A valve cartridge secured to the connection face is operable to conduct liquid between the intake passage and the bore. A vent valve mounted in the output bore has inner and outer seats and a valve body movable between end positions in each of which it blocks one of the seats. The outer seat lies between the inner seat and the connection face and the output passage opens into the bore between the seats. The bleed passage opens into the bore through the inner seat.

Thus with this system the vented backflow preventer is built right into the valve. The valve can be installed like a normal valve yet meets all the code requirements regarding backflow prevention.

The bore according to the invention is a blind bore centered on an axis substantially perpendicular to the connection face. The bleed passage perpendicularly intersects the bore. In addition the bleed passage has an inner end opening into the bore and an outer end opening to the atmosphere and above the inner end.

The housing in accordance with the invention is further formed with a drain passage having an upper end opening into the bore inward of the inner seat and an outer end below the respective inner end and opening to the atmosphere. The housing is normally recessed in a wall and a drain tube extends from the drain-passage outer end to outside the wall generally below the housing. An escutcheon plate fixed to the housing engages the wall and is formed with a drain hole. The drain tube opens behind the plate generally at the drain hole.

The vent valve according to the invention has a generally cylindrical sleeve set in the bore and the housing is provided with an end plate forming the connection face and secured over the sleeve to secure same in the bore. Screws secure the end plate on the housing and seals are provided between the end plate and the housing. Normally the vent valve includes a third valve seat inward of the inner and outer valve seats and a second valve body blockingly engageable with the third seat. Means such as a spring can be provided for urging the valve body against the outer seat. Normally each valve body is a ball. According to the invention a second such output port opens into the output passage and a valve in the output passage diverts flow therefrom alternately to the output ports.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
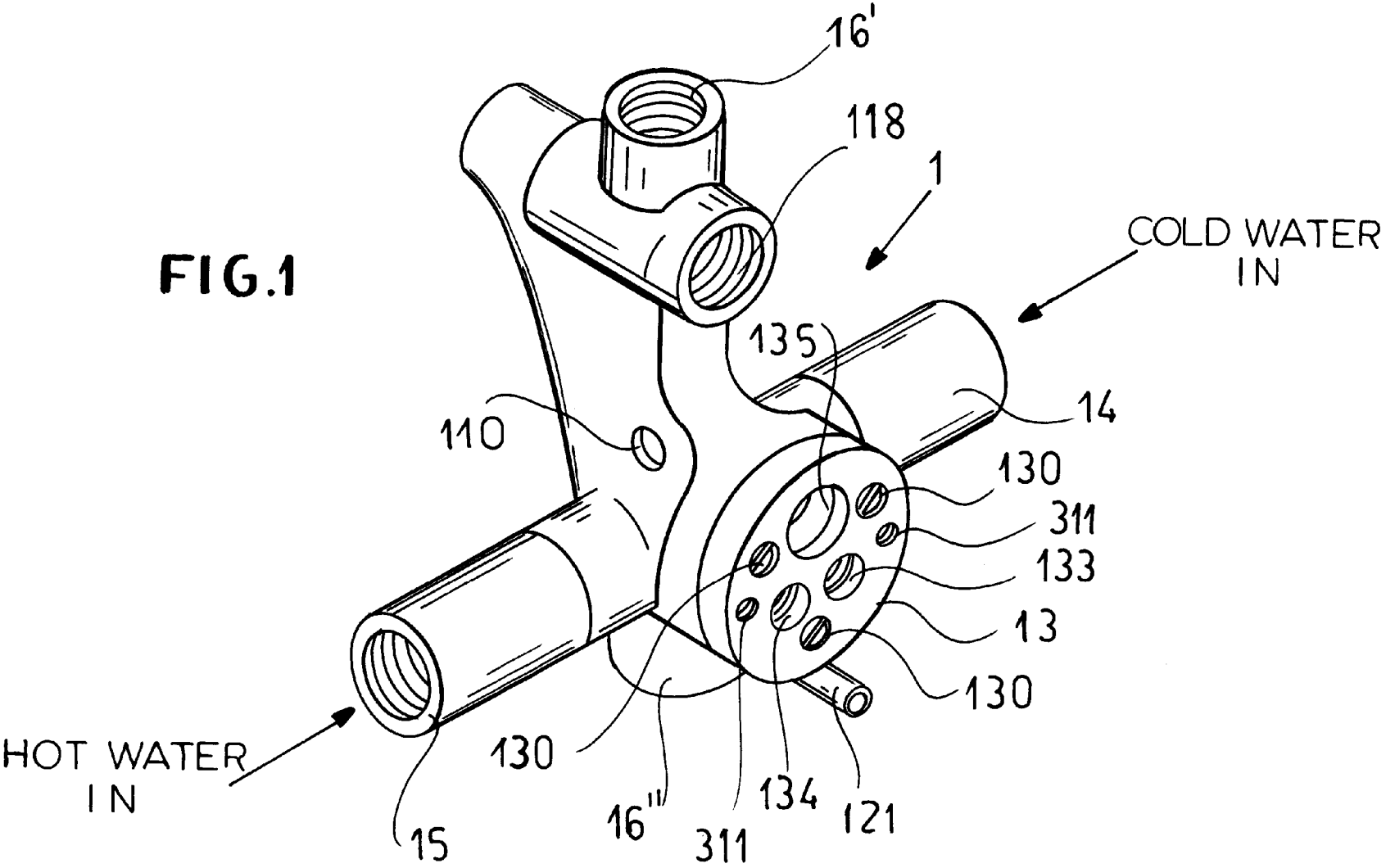
FIG. 1 is a perspective view of the basic housing of the valve according to the invention.
Figure 2:
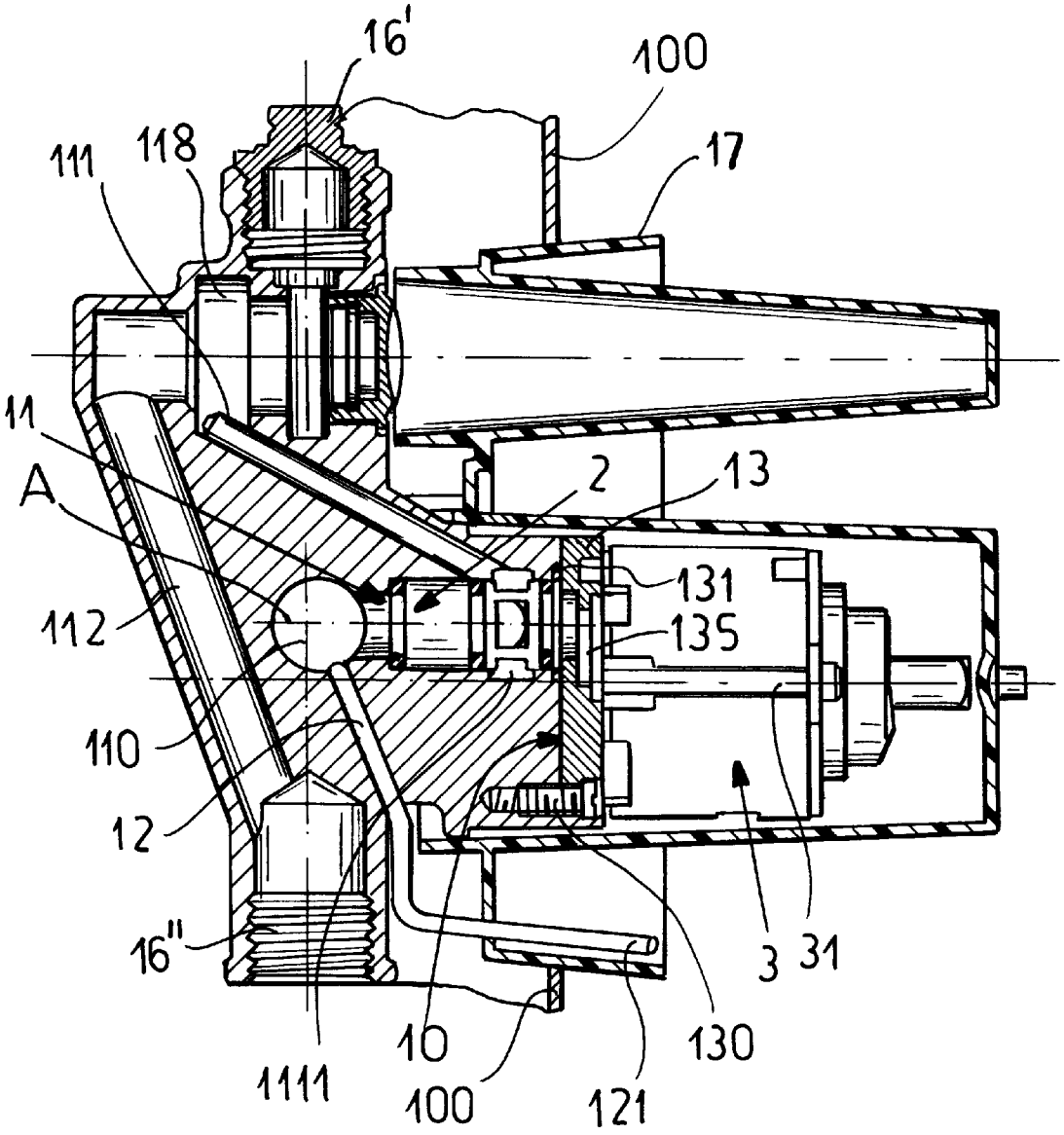
FIG. 2 is a vertical section through the valve during installation.
Figure 3:
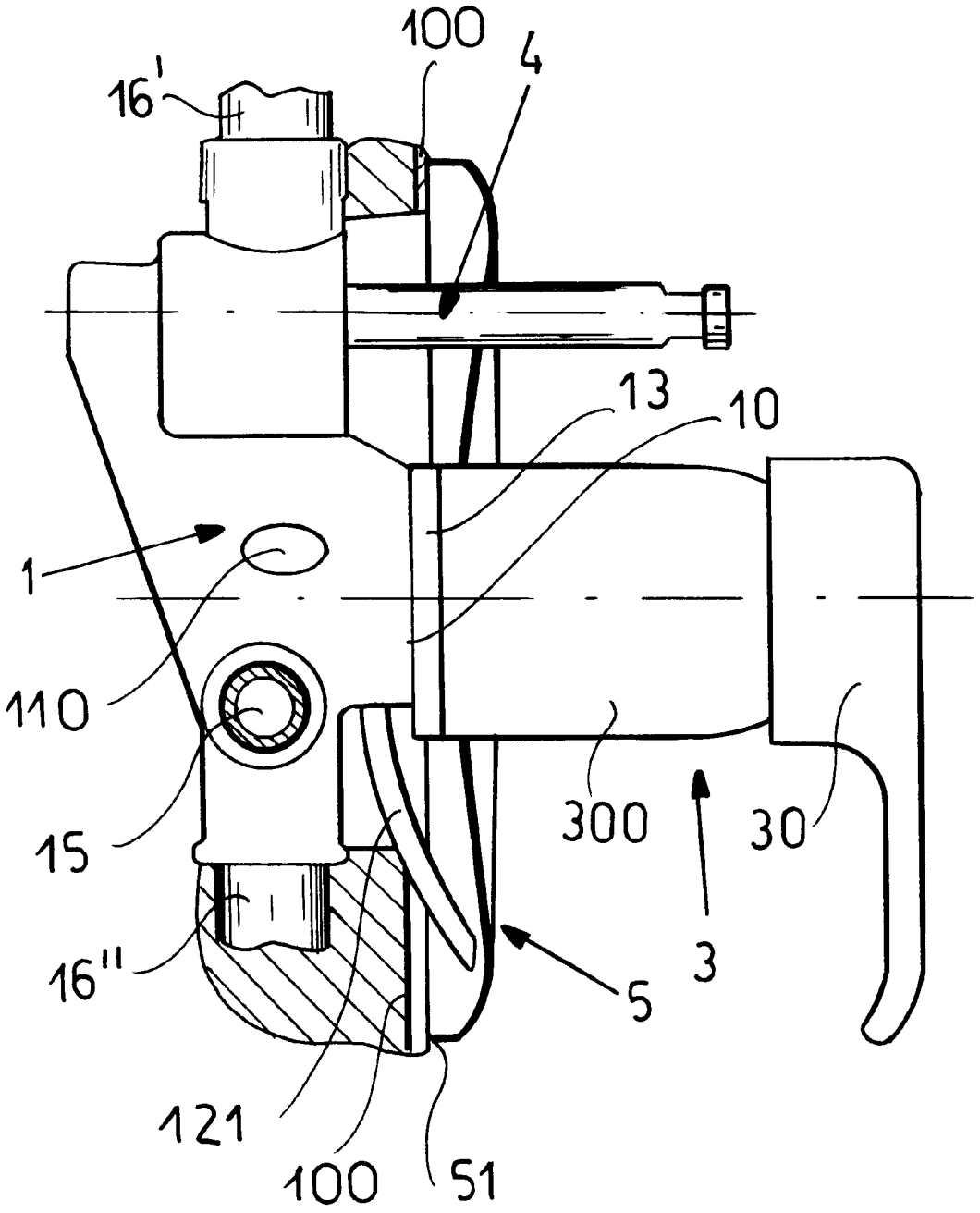
FIG. 3 is a vertical section showing the installed and complete valve according to the invention in side view.

As seen in FIGS. 1 through 3 a valve housing 1 according to the invention is formed with lateral coaxial input ports or connections 14 and 15 for cold and hot water under pressure and with coaxial output ports or connections 16' and 16" to which a shower and a spout can be connected. The housing 1 further has a planar face 10 to which a connection plate 13 is secured by screws 130, with seals 131 between the plate 13 and the face 10. Cold- and hot-water input passages extending from the ports 14 and 16 have ends 133 and 134 opening at the plate 13. A bore 11 formed in the housing 1 opens at 135 at the plate 130 and has an axis A perpendicular to the face 10 and plate 13. A double-element valve 2 described below is carried in this bore 11, clamped in place against a shoulder therein by the plate 13. In addition the housing 1 is formed with an output passage 111 that opens into an annular groove 1111 formed in the bore 11, with a compartment 118 into which the passage 111 opens and into which the upper outlet port 16' opens, with a passage 112 extending from the compartment 778 to the lower port 76", and with a crosswise vent passage 110 that communicates with a rear end of the bore 11. The vent passage 110 is generally V-shaped with a lower center at the bore 11 and raised outer ends. A drain passage 12 extended as a thin tube 121 extends downward from the passage 110 at the rear end of the bore 11.

A standard valve cartridge 3 is secured by screws 31 seated in bores 311 of the plate 13 to this plate 13. This cartridge 3 is standard and serves to feed the pressurized water at the passage ends 133 and 134 to the opening 135 of the bore 11. Similarly a diverting valve 4 is provided in the chamber 118 and serves to divert pressurized water from the passage 111 to the one port 16' (shown plugged in FIG. 2) or to the other port 16".

Figure 4:
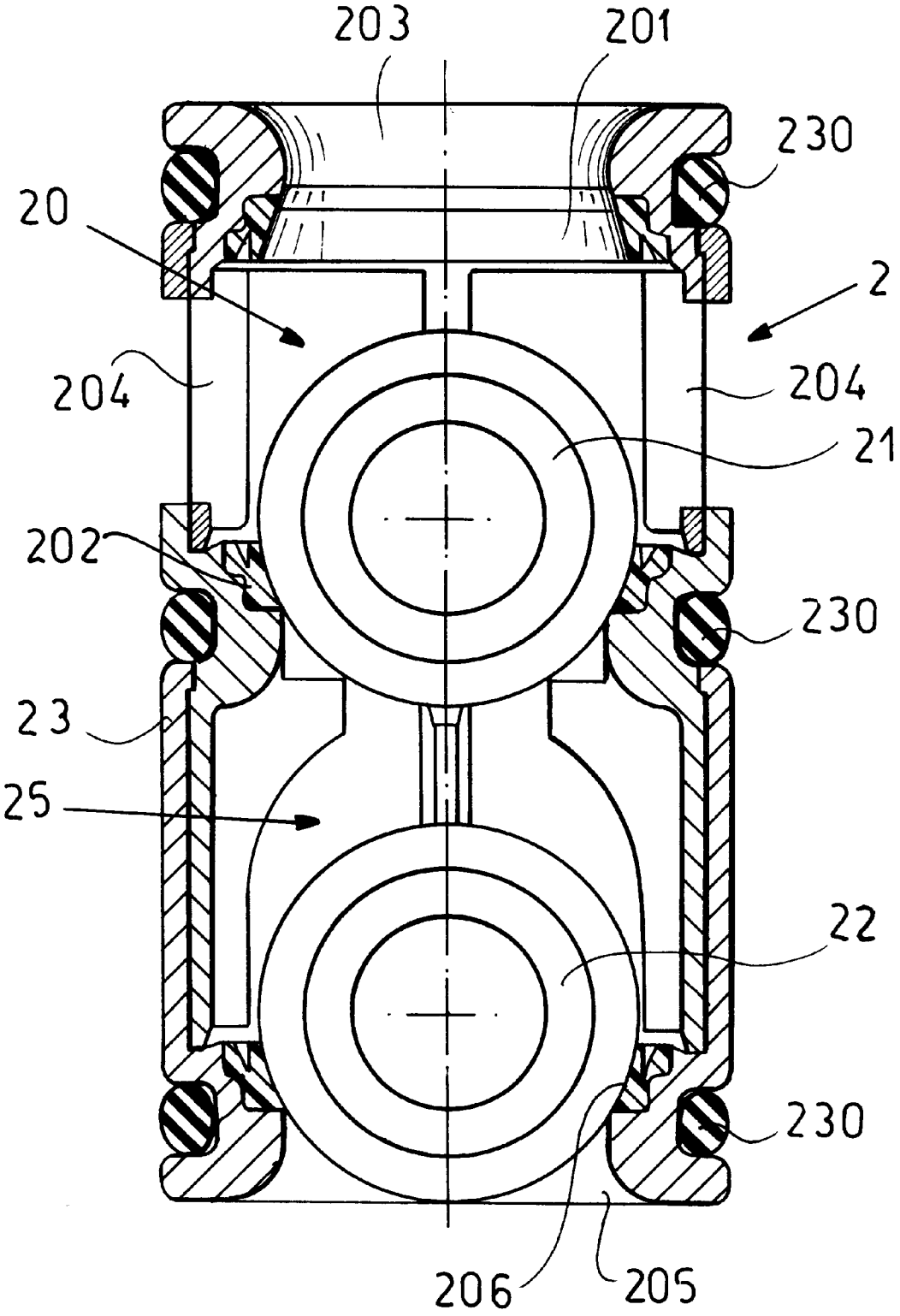
FIG. 4 is a large-scale sectional view of a detail of the valve.

The valve 2 as shown in FIG. 4 comprises a sleeve 23 formed with an inner opening 203 that is right behind the opening 135, a lateral opening 204 communicating via the groove 1111 with the passage 111, and a rear opening 205 communicating with the passages 110 and 12. In addition the sleeve 23 forms an outer seat 201, an inner seat 202, and an innermost seat 206 that cooperate,with valve bodies 21 and 22 forming valve subassemblies 20 and 25. O-ring seals 230 engage the inner wall of the bore 11 to hold the sleeve 23 in place and prevent leakage around it. The body 21 can move between an outer position fitting in the seat 201 and blocking flow out of the opening 203 and an inner position fitting in the seat 202 and blocking flow out of the opening 205. Similarly the body 22 of the subassembly 25 can fit in the seat 206 to further block flow out the opening 205.

Figure 5:
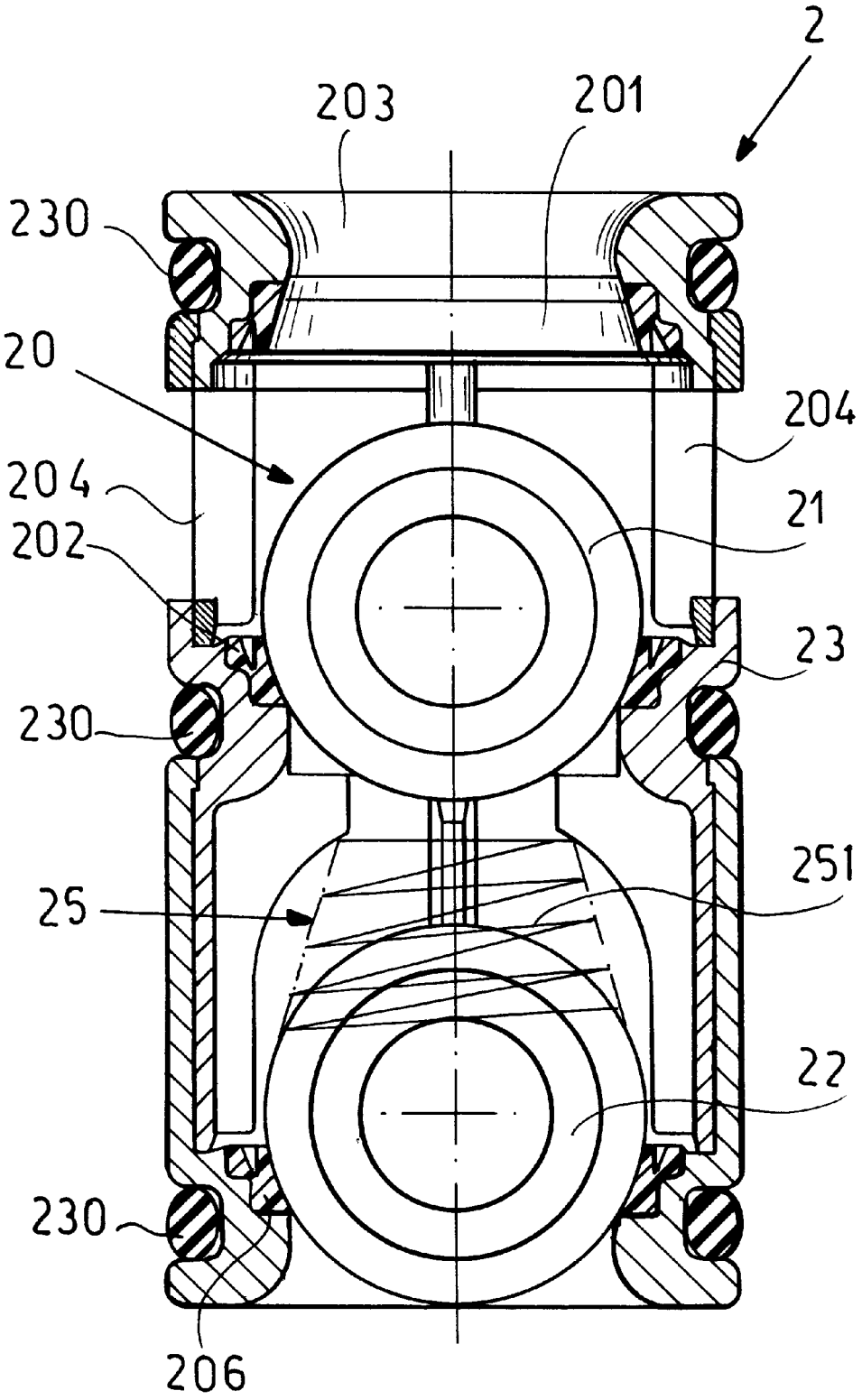
FIG. 5 is a view like FIG. 4 of a variant on the valve of this invention.

FIG. 5 shows how a spring 251 can bias the ball 22 of the subassembly 25 into engagement with the seat 206. This is useful when the valve is oriented in the illustrated upright position, in which case the balls 21 and 22 are made of light material so they float.

For installation the valve 4 is not normally in place and a sacrificial molded plastic part 17 is fitted to the valve housing 1. After installation, normally by plastering in a wet wall 100, this part 17 is pulled off and discarded and the valve 4 is screwed into the compartment 118. Then an escutcheon plate 5 with a lower drain hole 51 is fitted in place and retained there by a sleeve 300 screwed over the cartridge 3. A lever-type handle 30 is mounted on the cartridge 3 to finish the assembly.

In use the pressurized hot and cold water is fed by the valve cartridge 3 to the outer end of the valve 2. Under normal circumstances it will push back the valve ball 21 and flow out the opening 204 to move along the passage 111 to the valve 4 which will send it, depending on setting, to the port 16' or 16". If any water gets past the valve subassembly 20 it will normally be stopped by the valve subassembly 25 and if it gets past here it will be drained out via the passage 12 and tube 121. Since the escutcheon plate 5 has a drain opening 51, the water from the drain tube 121 will be harmlessly directed into the underlying tub or sink.

If however there is a pressure inversion, that is the passage end 135 is subjected to lower pressure than the passage 111 and if at the same time a telephone shower connected, for example, to the output 16' is sitting in a body of dirty water, the valve 2 reacts to prevent backflow of this dirty water into the input lines. This happens in that the valve body 21 will reverse and engage the seat 201, blocking flow back to the ports 14 and 15. The valve body 22 will similarly move outward, applying atmospheric pressure from the passage 110 to the passage 111, causing it to drain.

We claim:

1. A valve housing adapted to be recessed beneath a wall and comprising a body formed with:

a connection face adapted to carry a valve cartridge accessible from outside the wall, an intake port adapted to be connected to a supply of pressurized liquid, an output port, an intake passage extending from the intake port to the connection face, a bore extending from the connection face, an output passage extending from the bore to the output port, a bleed passage communicating with the atmosphere and opening into the bore; and a drain passage having an upper end opening into the bore and an outer end below the inner end and opening to the atmosphere;

a vent valve mounted in the bore and having inner and outer seats and a valve body moveable between end positions in each of which it blocks one of the seats, the outer seat lying between the inner seat and the connection face, the output passage opening into the bore between the seats, the bleed passage opening into the bore through the inner seat; and an end plate secured to the connection face and retaining the vent valve in the bore.

2. The valve housing defined in claim 1 wherein the bore is a blind bore centered on an axis substantially perpendicular to the connection face, the bleed passage perpendicularly intersecting the bore.

3. The valve housing defined in claim 1 wherein the bleed passage has an inner end opening into the bore and an outer end opening to the atmosphere and above the bleed-pressure inner end.

4. The valve housing defined in claim 1, further comprising a drain tube extending from the drain-passage outer end to outside the wall generally below the housing.

5. The valve housing defined in claim 4, further comprising an escutcheon plate fixed to the housing, engaging the wall, and formed with a drain hole, the drain tube opening behind the plate generally at the drain hole.

6. The valve housing defined in claim 1 wherein the vent valve has a generally cylindrical sleeve set in the bore.

7. The valve housing defined in claim 6, further comprising screws securing the end plate on the housing; and seals between the end plate and the housing.

8. The valve housing defined in claim 1 wherein the vent valve includes a third valve seat inward of the inner and outer valve seats and a second valve body blockingly engageable with the third seat.

9. The valve housing defined in claim 1 wherein the vent valve includes means for urging the valve body against the outer seat.

10. The valve housing defined in claim 1 wherein the valve body is a ball.

11. The valve housing defined in claim 1, further comprising a second such output port opening into the output passage; and valve means in the output passage for diverting flow therefrom alternately to the output ports.

* * * * *